US007974383B2

(12) United States Patent
August

(10) Patent No.: US 7,974,383 B2
(45) Date of Patent: Jul. 5, 2011

(54) SYSTEM AND METHOD TO MAINTAIN TARGET MATERIAL IN DUCTILE STATE

(75) Inventor: Ryan Paul August, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 54 days.

(21) Appl. No.: 12/330,581

(22) Filed: Dec. 9, 2008

(65) Prior Publication Data

US 2010/0142680 A1 Jun. 10, 2010

(51) Int. Cl.
*H01J 35/00* (2006.01)

(52) U.S. Cl. ..... 378/127; 378/111; 378/134

(58) Field of Classification Search ..... 378/111, 378/112, 113, 127, 134
See application file for complete search history.

(56) References Cited

U.S. PATENT DOCUMENTS

| | | | | |
|---|---|---|---|---|
| 3,567,939 | A * | 3/1971 | Schadler et al. | 378/112 |
| 3,694,685 | A * | 9/1972 | Houston | 378/127 |
| 4,631,742 | A * | 12/1986 | Oliver | 378/113 |
| 4,853,946 | A * | 8/1989 | Elliott et al. | 378/4 |
| 7,120,222 | B2 * | 10/2006 | Hoffman | 378/134 |
| 2006/0193438 | A1 * | 8/2006 | Radley et al. | 378/119 |

* cited by examiner

*Primary Examiner* — Chih-Cheng G Kao
(74) *Attorney, Agent, or Firm* — Ziolkowski Patent Solutions Group, SC

(57) ABSTRACT

An x-ray tube includes a frame, an anode for generating x-rays disposed within the frame, a cathode disposed within the frame, where the cathode is configured to selectively emit an electron beam toward the anode, and at least one heating element disposed within the frame and configured to heat a portion of the anode.

20 Claims, 5 Drawing Sheets

SYSTEM AND METHOD TO MAINTAIN TARGET MATERIAL IN DUCTILE STATE

BACKGROUND OF THE INVENTION

The invention relates generally to x-ray tubes and, more particularly, to an apparatus for x-ray generation and a method of fabrication.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, the anode assembly may be rotated at a high rotational speed.

Between periods of x-ray production and periods of idle, the target material may experience a wide range of temperatures as it cools from operating temperature to room temperature. Within this wide range of temperatures, the target material may reach a temperature that represents the transition between a hot ductile state and a relatively cool brittle state, which may be referred to as a ductile-brittle transition temperature (DBTT). After a period of non-use, a warm-up scan may be used to preheat the target. A preheating scan allows the target to transition from the cooler brittle state to the warmer ductile state prior to high-power imaging protocols, thus reducing stress on the target material. However, due to operator error or scheduling requirements of the system, the preheating scan may be skipped, and the target material may drop below the DBTT, thus subjecting the target material to undesired stress and shortened target life.

Therefore, it would be desirable to have a method and apparatus to maintain an x-ray tube target within a desired temperature range and above the DBTT such that an imaging scanner may be used on demand without the need to perform a preheating scan.

BRIEF DESCRIPTION OF THE INVENTION

The present invention provides a system and method to maintain a selected portion of an x-ray tube anode in a ductile state.

According to one aspect of the invention, an x-ray tube includes a frame, an anode for generating x-rays disposed within the frame, a cathode disposed within the frame, where the cathode is configured to selectively emit an electron beam toward the anode, and at least one heating element disposed within the frame and configured to heat a portion of the anode.

In accordance with another aspect of the invention, a method of fabricating an electromagnetic energy source includes positioning a cathode to emit a primary electron beam toward a target. The method further includes positioning a heater to apply heat to a portion of the target to maintain the portion of the target above a specified temperature when the cathode is not emitting the primary electron beam.

Yet another aspect of the invention includes an imaging system having a rotatable gantry, which has a detector and an x-ray tube mounted thereto. The x-ray tube includes a structure enclosing a cavity, a target positioned within the cavity, a cathode positioned within the cavity and configured to direct current from the cathode to the target, and a heat source located remotely from the cathode.

Various other features and advantages of the invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
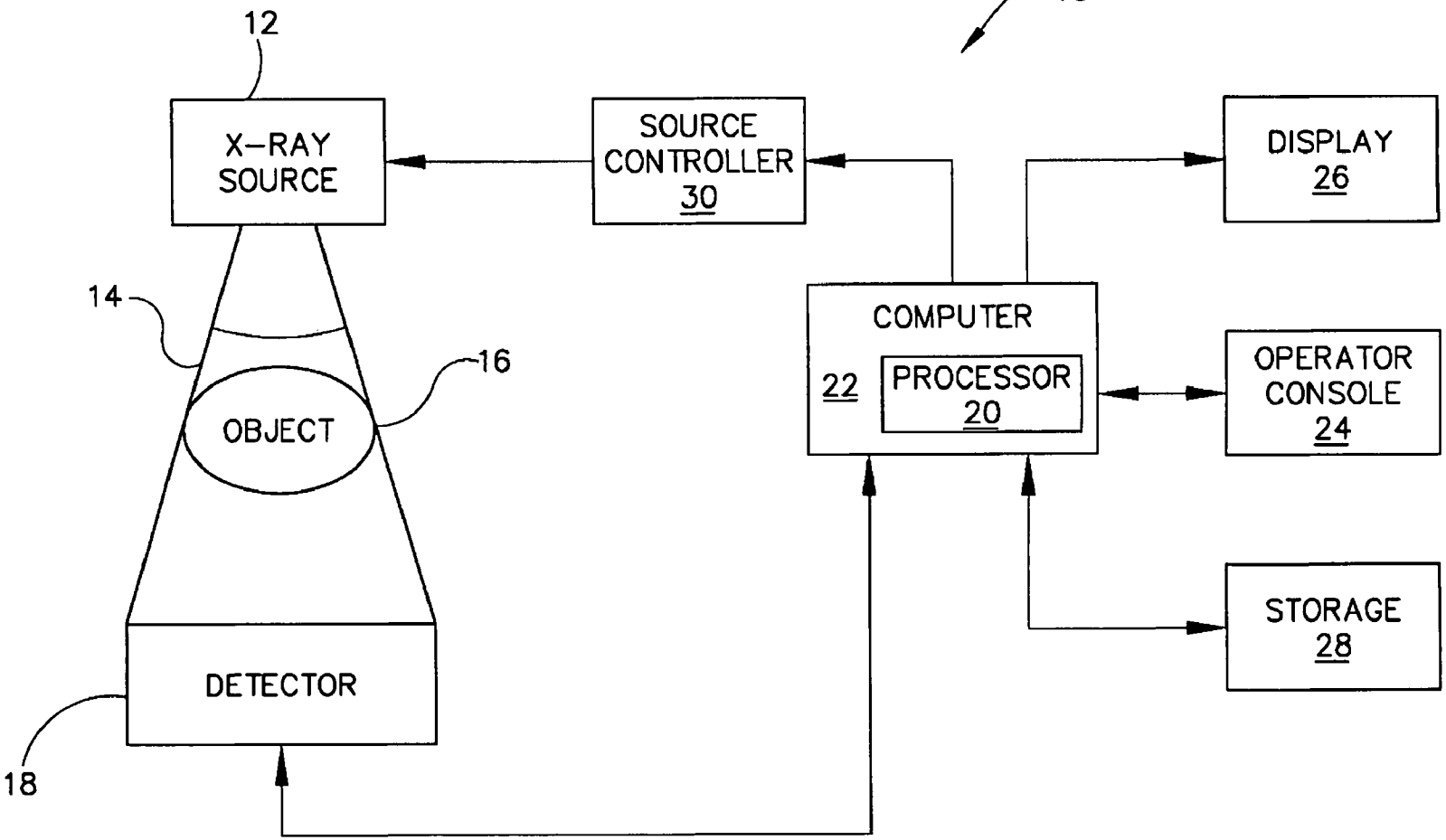
FIG. 1 is a block diagram of an imaging system that can benefit from incorporation of an embodiment of the invention.

FIG. 1 is a block diagram of an embodiment of an imaging system 10 designed both to acquire original image data and to process the image data for display and/or analysis in accordance with the invention. It will be appreciated by those skilled in the art that the invention is applicable to numerous medical imaging systems implementing an x-ray tube, such as an x-ray system, a vascular system, and a mammography system. Other imaging systems such as CT systems and digital radiography systems, which acquire image three dimensional data for a volume, also benefit from the invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Moreover, the invention will be described with respect to use in an x-ray tube. However, one skilled in the art will further appreciate that the invention is equally applicable for other systems that may benefit from reducing a number of heating cycles wherein a material transitions above and below a DBTT.

Figure 2:
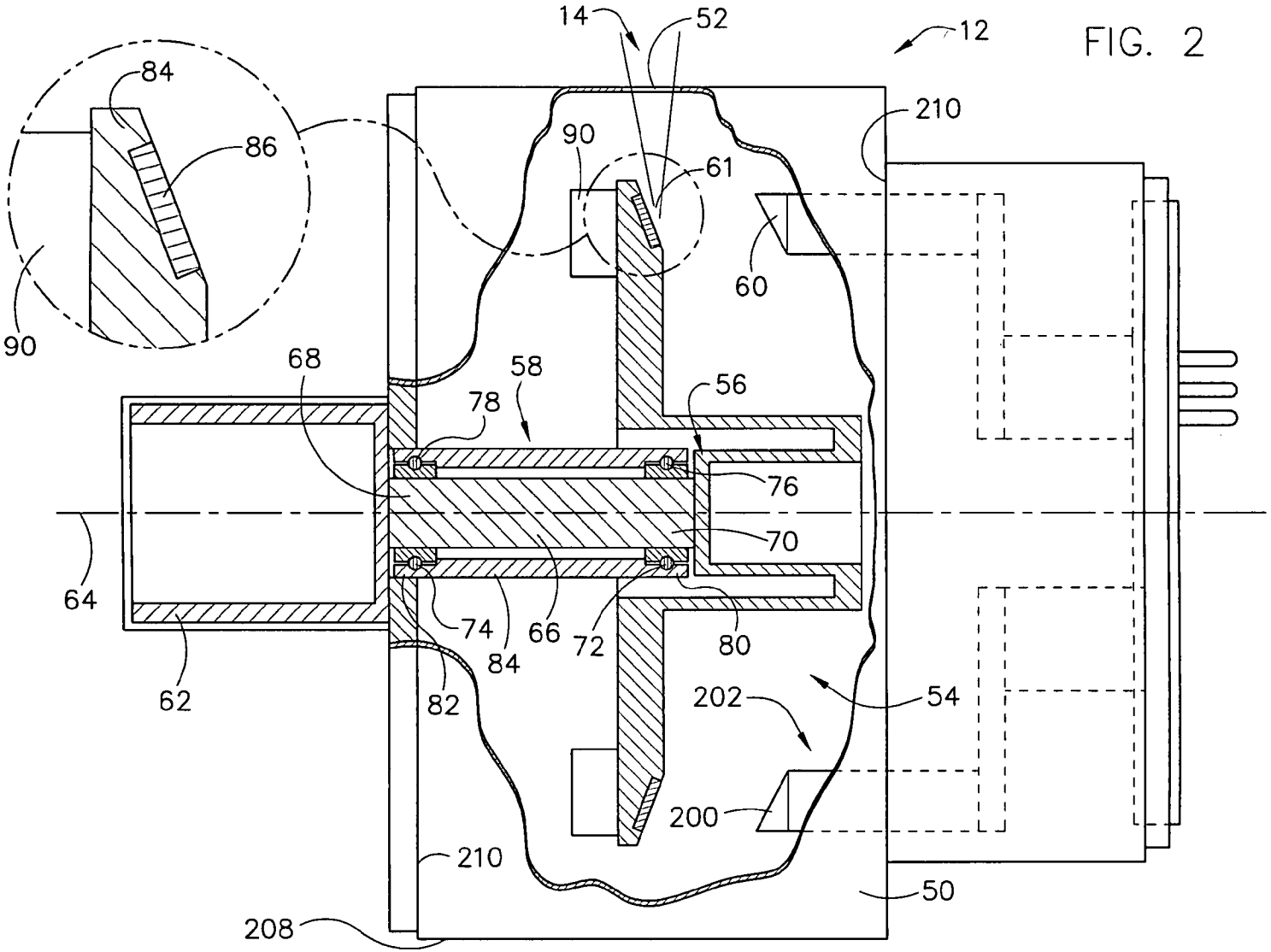
FIG. 2 is a cross-sectional view of an x-ray tube useable with the system illustrated in FIG. 1 according to an embodiment of the invention.

FIG. 2 illustrates a cross-sectional view of an x-ray tube 12 that can benefit from incorporation of an embodiment of the invention. The x-ray tube 12 includes a casing 50 having a radiation emission passage 52 formed therein. The casing 50 encloses a vacuum 54 and houses an anode or target 56, a bearing assembly 58, a cathode 60, and a rotor 62. X-rays 14 are produced when high-speed electrons from a primary electron beam are suddenly decelerated when directed from the cathode 60 to the target 56 via a potential difference therebetween. In high voltage CT applications, the potential difference between the cathode 60 and target 56 may be, for example, 60 thousand volts or more. In other applications, the potential difference may be lower. The electrons impact a material layer or target track 86 at focal point 61 and x-rays 14 emit therefrom. The point of impact at focal point 61 is typically referred to in the industry as the focal spot. The x-rays 14 emit through the radiation emission passage 52 toward a detector array, such as detector 18 of FIG. 1. In high voltage CT applications, to avoid overheating the target 56 from the electrons, the target 56 is rotated at a high rate of speed about a centerline 64 at, for example, 90-250 Hz. In lower voltage applications, the target 56 may remain stationary.

The bearing assembly 58 includes a center shaft 66 attached to the rotor 62 at first end 68 and attached to the target 56 at second end 70. A front inner race 72 and a rear inner race 74 rollingly engage a plurality of front balls 76 and a plurality of rear balls 78, respectively. Bearing assembly 58 also includes a front outer race 80 and a rear outer race 82 configured to rollingly engage and position, respectively, the plurality of front balls 76 and the plurality of rear balls 78. Bearing assembly 58 includes a stem 83 which is supported by the x-ray tube 12. A stator (not shown) is positioned radially external to and drives the rotor 62, which rotationally drives target 56. While FIG. 2 depicts a rotatable target 56, it is also contemplated that target 56 may be configured to remain stationary during an imaging application. The target 56 includes a target substrate 84, having target track 86 therein. A heat storage medium 90, such as graphite, may be used to sink and/or dissipate heat built-up near the target track 86.

FIG. 2 further illustrates a heat source 200 configured as an electron source (such as a second cathode) according to an embodiment of the invention. In an embodiment where heat source 200 is an electron source, heat source 200 may be located at a position 202 proximate the target 56 and configured to accelerate electrons toward the target 56 to cause heating therein, by passing a current through, for instance, a metal piece such as tungsten, of heat source 200 while applying a voltage between target 56 and heat source 200. In such an embodiment, heat source 200 may be controlled and electrons may be accelerated toward the target 56 using a low voltage, for example 10 KeV or less. One skilled in the art will recognize that any voltage may be applied that will allow heat source 200 to accelerate electrons toward the target 56 using a diffuse beam, and the applied voltage may be selected to avoid x-rays from being generated from the target 56.

Figure 3:
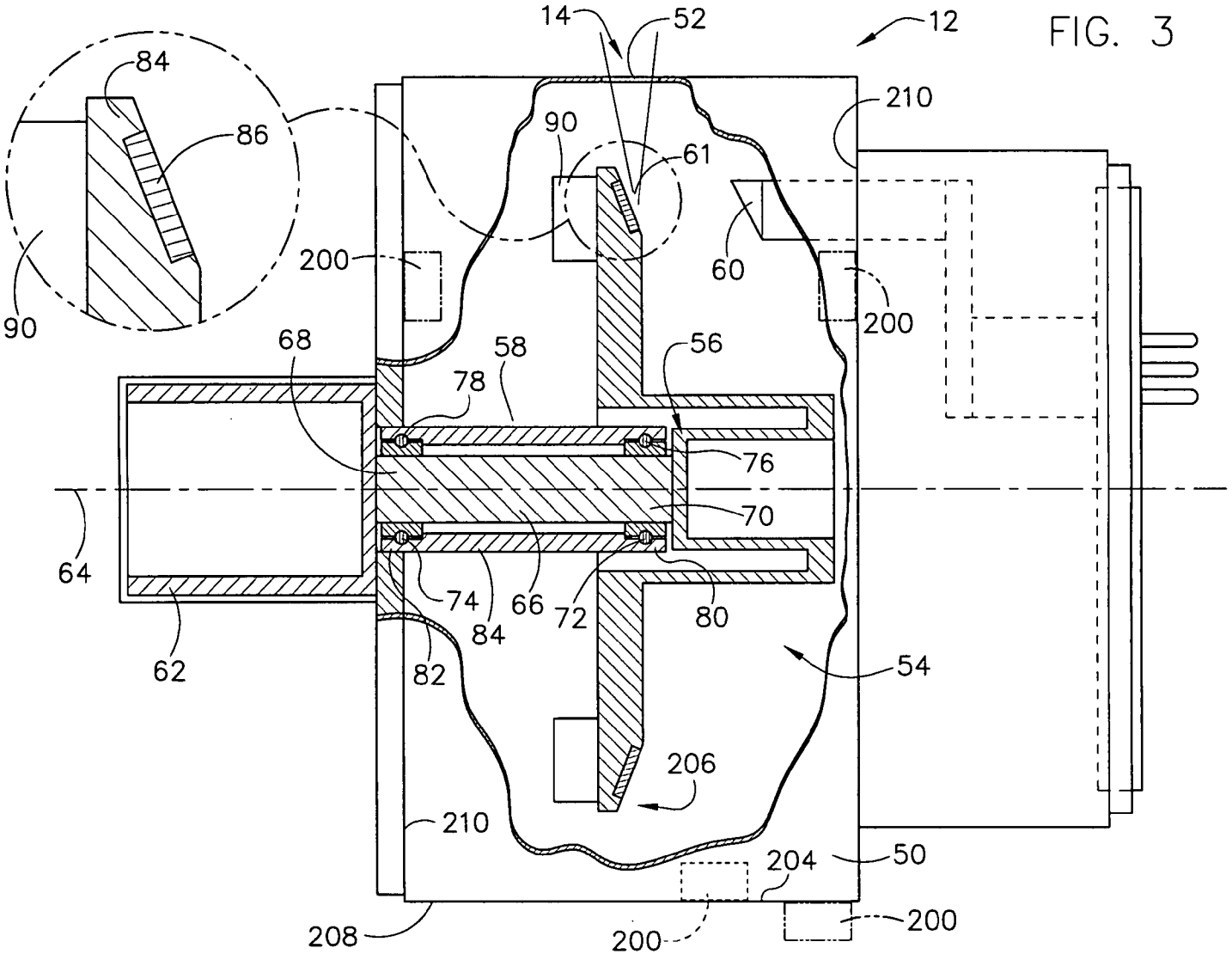
FIG. 3 is a cross-sectional view of an x-ray tube useable with the system illustrated in FIG. 1 according to another embodiment of the invention

Heat source 200 may also be an induction heater or a radiant heater, and the like, located at various positions within the x-ray tube 12, according to embodiments of the invention. As shown in FIG. 3, heat source 200 may be positioned on or within the x-ray tube 12 to generally apply heat to the target 56 or to direct heat to a desired location on the target 56, such as the target track 86, as an example. In a preferred embodiment, heat source 200 is positioned on an interior surface 204 of the casing 50 to direct heat towards an outside edge 206 of the target 56. Possible alternative locations for the heat source 200 include, but are not limited to, an external surface 208 of the x-ray tube 12 and an internal surface 210 of the x-ray tube 12.

Although FIGS. 2 and 3 illustrate heat source 200 at several discrete locations, it is contemplated that heat source 200 may be positioned at any location either on the casing 50 or within the x-ray tube vacuum 54 so as to heat the target 56 to a desired temperature. Furthermore, multiple heat sources 200 may be positioned on or within the x-ray tube 12 to achieve a desired temperature distribution within the target 56 or target track 86.

Figure 4:
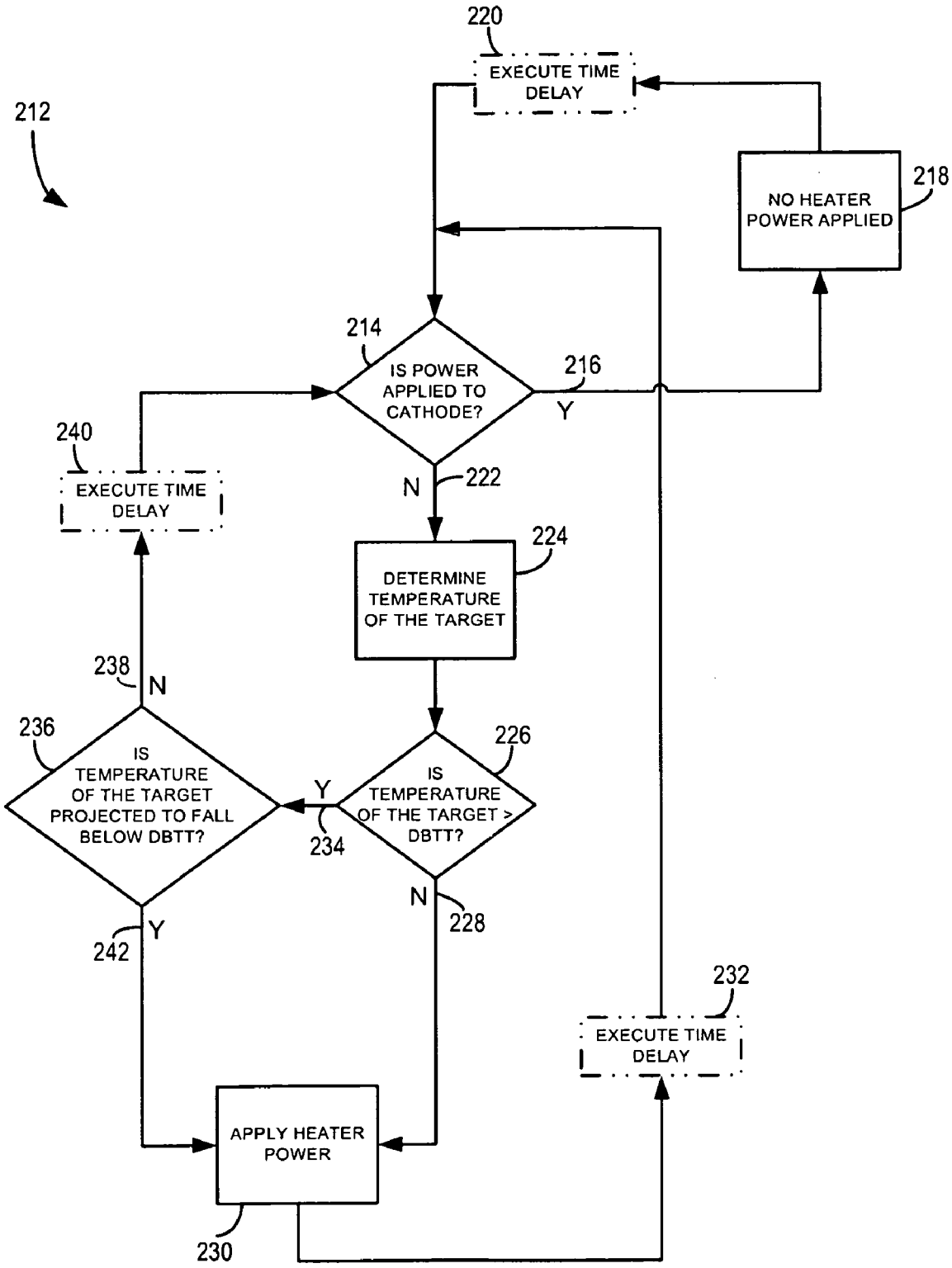
FIG. 4 is a flowchart of a target heating process according to an embodiment of the invention.

According to embodiments of the invention, heat may be applied to the target 56 according to a technique 212 as illustrated in FIG. 4. Technique 212 maintains a selected portion of the target 56 in a ductile state by selectively heating the target 56 of FIGS. 2 and 3 in order to maintain the temperature of either the entire target 56, or a selected portion thereof, above the DBTT. According to an exemplary embodiment of the invention, technique 212 maintains the temperature of the target track 86 of FIGS. 2 and 3 above the DBTT of the target track material. In one embodiment, technique 212 may regulate the temperature of the target 56, or more particularly the target track 86 as an example, by selectively controlling rotation of the target 56 while applying power to heat source 200 of FIGS. 2 and 3. In another embodiment, technique 212 may selectively apply power to multiple heaters 200 of x-ray tube 12 in order to achieve or maintain a desired temperature distribution in the target 56. According to another embodiment of the invention, technique 212 may be applied to a cold target as a tube-warming protocol to heat target 56 above the DBTT.

Technique 212 begins at step 214 by determining whether power is being applied to the cathode 60. If power is being applied to cathode 60 of FIGS. 2 and 3 216, then technique 212 transitions to step 218 and no power is applied to the heat source 200. At optional step 220, technique 212 executes a time delay prior to returning to step 214, which may avoid continuous looping in, for instance a computer program, while heater power is applied to cathode 60. Technique 212 then returns control to step 214 to determine anew if power is being applied to the cathode 60. In this fashion, technique 212 may monitor power directed toward the target and, if power is applied via the cathode, then no power is applied via the heater.

If power is not being applied 222 to the cathode 60, as determined at step 214, technique 212 continues to step 224 and the temperature of, for instance, the target track 86 is determined. Such determination may be via known algorithms that calculate or estimate a temperature of a target based on recently applied power thereto. At step 226, if the temperature of the target track 86 is not above the DBTT 228, such as during a period where the x-ray system is not in use or prior to tube warm-up, power is applied to the heat source 200 at step 230. In this instance, technique 212 may serve as a tube warm-up protocol and a total amount of energy input is calculated, accordingly. Following the application of power at step 230, technique 212 may enter an optional step 232 after which technique 212 cycles back to step 214 to determine if power has been applied to cathode 60 in the time period since the temperature of the target track 86 was last determined. At steps 224 and 226, technique 212 again determines the temperature of the target track 86 and analyzes whether the temperature of the target track 86 is greater than the DBTT of the target track material to determine whether the applied heater power is sufficient. If the temperature of the target track 86 is below the DBTT 228, power remains, or alternately is again applied to the heater at step 230. Technique 212 continues to cycle between steps 224, 226, 230, through optional step 232, and back to step 214 until the temperature of the target track 86 is above the DBTT.

In an alternate path of technique 212, if at step 226 the temperature is determined to be above the DBTT 234, control moves to step 236 to determine whether the temperature is projected to fall below the DBTT. At step 236, technique 212 may take into consideration such factors as the temperature difference between the target track 86 and the DBTT, the temperature of the target 56, the ambient temperature, the estimated remaining idle time before power is to be applied to the cathode 60, the configuration of the x-ray tube 12, cooling time constants, and the like. If, at step 236, the temperature of the target track 86 is not projected to fall below the DBTT 238, technique 212 cycles back to step 214 to determine whether power has been applied to the cathode 60. Prior to returning to step 214, technique 212 may enter optional wait step 240, wherein technique 212 executes a time delay before determining whether power is applied to the cathode 60. If the temperature of the target track 86 is projected to fall below the DBTT 242, however, technique 212 again applies power to the heater at step 230. After applying power to the heater, technique 212 cycles back to step 214 to determine if power is applied to the cathode 60, and if not 222, the temperature of the target track 86 is determined anew at step 224.

The amount and timing of the power applied to the heat source 200 at step 230 may be controlled based on numerous input parameters, including the determined temperature of the target 56 or target track 86, ambient conditions, the configuration of the x-ray tube, the construction and material properties of the target 56, and the like. Thus, in embodiments of the invention, power may be applied in intermittent pulses, or may be continuously applied, while the algorithm operates and cycles until the temperature is above the DBTT.

As such, technique 212 may be applied to an x-ray tube as a tube-warming procedure or to maintain a selected portion of the x-ray tube at a desired temperature between scans of an imaging device. If the target temperature is below the DBTT 228, such as when starting imaging system 10 when cold, technique 212 will apply heater power 224 until the target temperature is above the DBTT 234. If the target temperature is above the DBTT 234 but between scans as an example, technique 212 may also apply power to the heater 224 if the temperature is projected to fall below the DBTT 242. And, if power is being applied via a cathode 216, technique 212 will refrain from applying heater power and cycle or delay until no cathode power is applied. Accordingly, technique 212 will heat and maintain a target above the DBTT, thus minimizing the number of thermal cycles therethrough.

Figure 5:
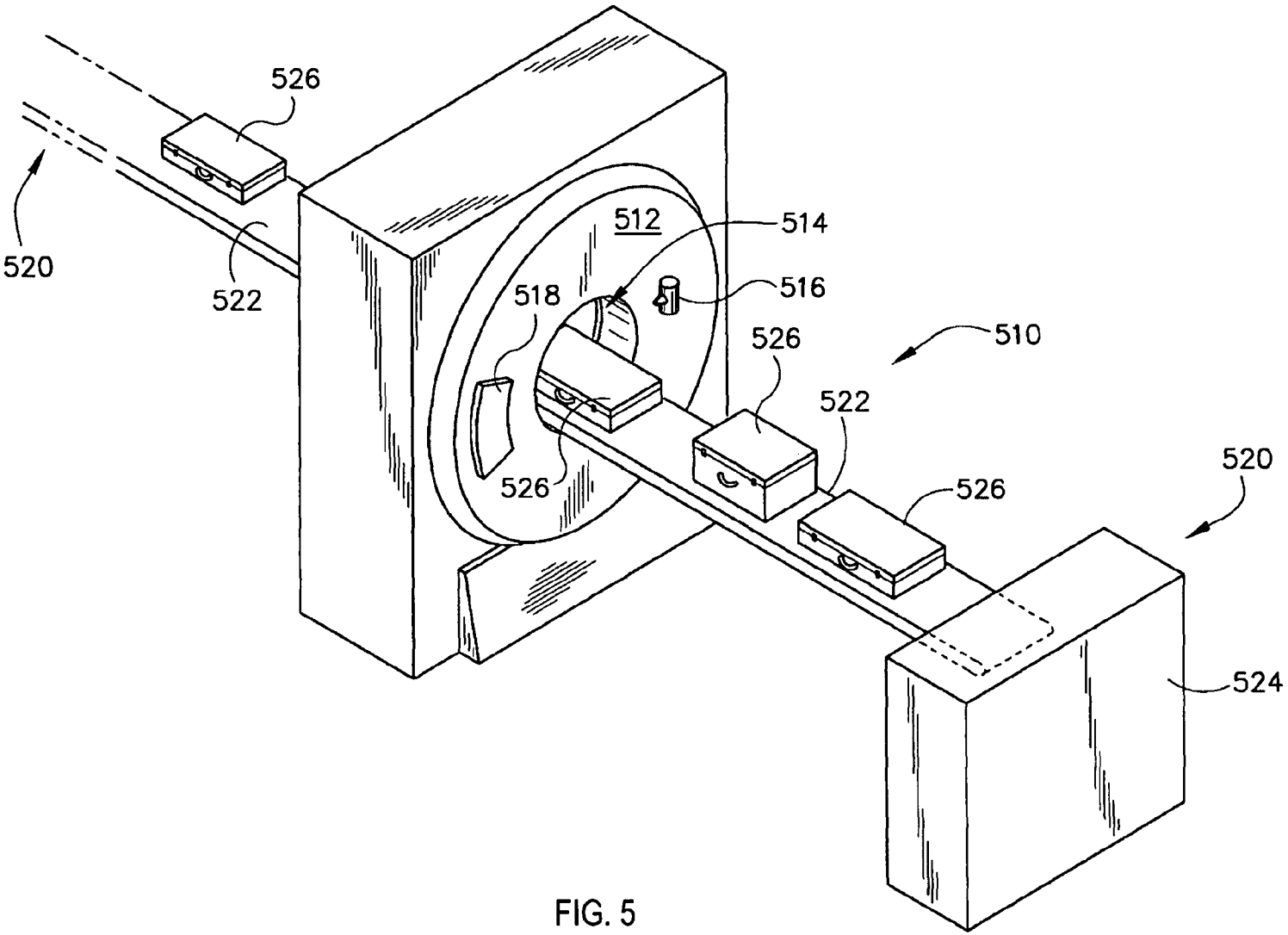
FIG. 5 is a pictorial view of a CT system for use with a non-invasive package inspection system.

Referring now to FIG. 5, package/baggage inspection system 510 includes a rotatable gantry 512 having an opening 514 therein through which packages or pieces of baggage may pass. The rotatable gantry 512 houses an x-ray energy source 516 as well as a detector assembly 518 having scintillator arrays comprised of scintillator cells. A conveyor system 520 is also provided and includes a conveyor belt 522 supported by structure 524 to automatically and continuously pass packages or baggage pieces 526 through opening 514 to be scanned. Objects 526 are fed through opening 514 by conveyor belt 522, imaging data is then acquired, and the conveyor belt 522 removes the packages 526 from opening 514 in a controlled and continuous manner. As a result, postal inspectors, baggage handlers, and other security personnel may non-invasively inspect the contents of packages 526 for explosives, knives, guns, contraband, etc.

According to one aspect of the invention, an x-ray tube includes a frame, an anode for generating x-rays disposed within the frame, a cathode disposed within the frame, where the cathode is configured to selectively emit an electron beam toward the anode, and at least one heating element disposed within the frame and configured to heat a portion of the anode.

In accordance with another aspect of the invention, a method of fabricating an electromagnetic energy source includes positioning a cathode to emit a primary electron beam toward a target. The method further includes positioning a heater to apply heat to a portion of the target to maintain the portion of the target above a specified temperature when the cathode is not emitting the primary electron beam.

Yet another aspect of the invention includes an imaging system having a rotatable gantry, which has a detector and an x-ray tube mounted thereto. The x-ray tube includes a structure enclosing a cavity, a target positioned within the cavity, a cathode positioned within the cavity and configured to direct current from the cathode to the target, and a heat source located remotely from the cathode.

The invention has been described in terms of the preferred embodiment, and it is recognized that equivalents, alternatives, and modifications, aside from those expressly stated, are possible and within the scope of the appending claims.

What is claimed is:

1. An x-ray system comprising:

an x-ray tube comprising:

a frame;

an anode disposed within the frame;

a cathode disposed within the frame, the cathode configured to selectively emit an electron beam toward the anode; and at least one heating element disposed within the frame and configured to heat a portion of the anode; and an x-ray controller configured to:

estimate a temperature of the anode using an algorithm that includes power previously applied thereto;

project when the anode is expected to fall below a ductile-brittle transition temperature (DBTT) based on the estimated temperature;

calculate an amount of power to be applied to heat the anode above the DBTT; and apply the calculated amount of power to the at least one heating element.

2. The x-ray system of claim 1 wherein the at least one heating element is configured to selectively heat the portion of the anode to a temperature above the DBTT of the anode when the cathode is not emitting the electron beam.

3. The x-ray system of claim 1 wherein the at least one heating element comprises a plurality of heating elements disposed within the frame, each of the plurality of heating elements configured to heat the anode.

4. The x-ray system of claim 3 wherein the plurality of heating elements is positioned within the frame such that an approximately uniform temperature distribution is maintained within the anode.

5. The x-ray system of claim 1 wherein the at least one heating element is configured to heat one of a top surface, an outside edge, and a bottom surface of the anode.

6. The x-ray system of claim 1 wherein the at least one heating element is one of a radiant heater and an inductive heater.

7. The x-ray system of claim 1 wherein the at least one heating element is a cathode that is configured to emit electrons toward the anode as a diffuse beam at a voltage below which x-rays are produced.

8. A method of fabricating an electromagnetic energy source comprising:

positioning a cathode to emit a primary electron beam toward a target;

positioning a heater to apply an amount of heat to a portion of the target to maintain the portion of the target above a specified temperature when the cathode is not emitting the primary electron beam; and providing a control algorithm for the heater, wherein the control algorithm is configured to estimate a temperature of the target, project when the temperature is expected to fall below a ductile-brittle transition temperature (DBTT), and calculate the amount of heat to apply to the portion of the target based on the estimation.

9. The method of claim 8 wherein positioning the heater to apply heat to the portion of the target above the specified temperature comprises heating the portion of the target above the ductile-brittle transition temperature of the target.

10. The method of claim 8 comprising coupling a processor to the heater and configuring the processor to operate the control algorithm.

11. The method of claim 10 comprising configuring the algorithm to selectively control a rotation of the target.

12. The method of claim 11 comprising configuring the algorithm to rotate the target while applying the heat to the portion of the target.

13. The method of claim 8 comprising configuring the heater to apply one of inductive heat and irradiative heat.

14. The method of claim 8 comprising configuring the heater to emit a secondary electron beam toward the target.

15. The method of claim 14 comprising configuring a processor to limit an amount of voltage supplied to the heater to avoid causing x-ray generation from the target.

16. An x-ray imaging system comprising:

a rotatable gantry;

a detector mounted to the rotatable gantry;

an x-ray tube mounted to the rotatable gantry, the x-ray tube comprising:

a structure enclosing a cavity;

a target positioned within the cavity;

a primary cathode positioned within the cavity and configured to direct current from the primary cathode to the target; and a heat source located remotely from the primary cathode; and a controller configured to:

estimate whether a temperature of the target is projected to fall below a ductile-brittle transition temperature (DBTT) if no power were to be applied to the primary cathode; and apply power to the heat source to heat the target above the DBTT.

17. The system of claim 16 wherein the controller is configured to control energy applied to the heat source sufficient to maintain the target above a desired temperature.

18. The system of claim 17 wherein the desired temperature is a temperature above which a portion of the target is in a ductile state.

19. The system of claim 16 wherein the heat source is a secondary cathode mounted within the cavity.

20. The system of claim 19 comprising a generator configured to apply a voltage between the heat source and the target, wherein the voltage is less than 10 KeV.

* * * * *